United States Patent [19]

Tomlinson

[11] 4,115,994

[45] Sep. 26, 1978

[54] DIAL ILLUMINATION MEANS

[76] Inventor: James N. Tomlinson, 1114 Kathryn St., Boalsburg, Pa. 16827

[21] Appl. No.: 705,569

[22] Filed: Jul. 13, 1976

[51] Int. Cl.[2] ..... G04B 39/00; G04B 19/30

[52] U.S. Cl. ..... 58/50 R; 362/23; 362/26; 362/30; 58/91

[58] Field of Search ..... 58/23 R, 50 R, 88 G, 58/91, 127 R; 240/2.1, 6.43

[56] References Cited

U.S. PATENT DOCUMENTS

| | | | |
|---|---|---|---|
| 2,696,550 | 12/1954 | Neugass | 240/2.1 |
| 3,018,614 | 1/1962 | Brien | 58/91 X |
| 3,224,184 | 12/1965 | Brien | 58/50 R |
| 3,681,587 | 8/1972 | Brien | 58/50 R |
| 3,788,061 | 1/1974 | Tonquist | 58/50 R |
| 3,855,784 | 12/1974 | Foelner | 58/50 R |
| 3,899,871 | 8/1975 | Kitai | 58/50 R |
| 3,943,694 | 3/1976 | Hofer | 58/50 R |
| 3,991,552 | 11/1976 | Ho et al. | 58/50 R |

FOREIGN PATENT DOCUMENTS

| | | | |
|---|---|---|---|
| 492,258 | 9/1938 | United Kingdom | 240/2.1 |

*Primary Examiner*—Edith S. Jackmon

*Attorney, Agent, or Firm*—Mason, Fenwick & Lawrence

[57] ABSTRACT

A watch is disclosed having a face with visual hour indicators illuminated by a light emitting diode embedded in a transparent crystal for emitting light to flow outwardly through the crystal to engage a surrounding reflector surface which concentrates the light in the area of the visual hour indicators.

16 Claims, 7 Drawing Figures

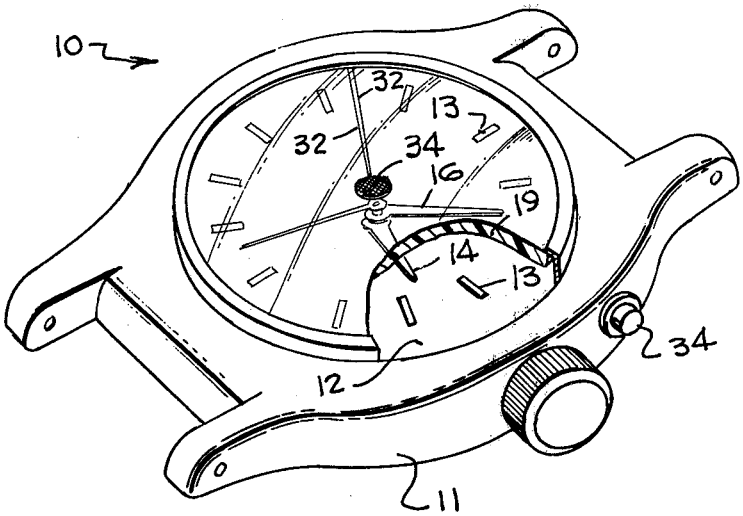
Fig-1
Fig-2
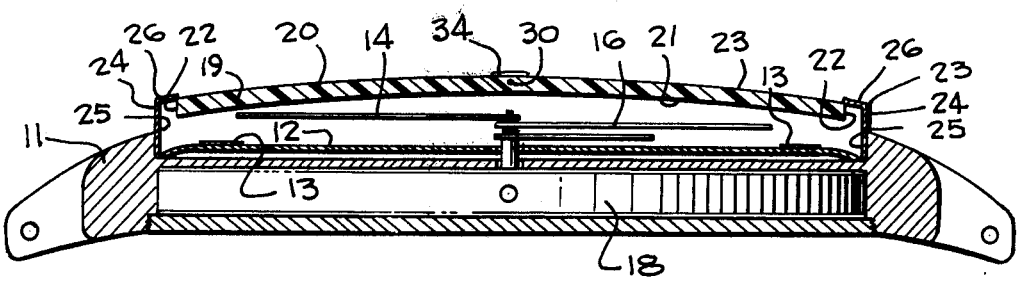
Fig-3
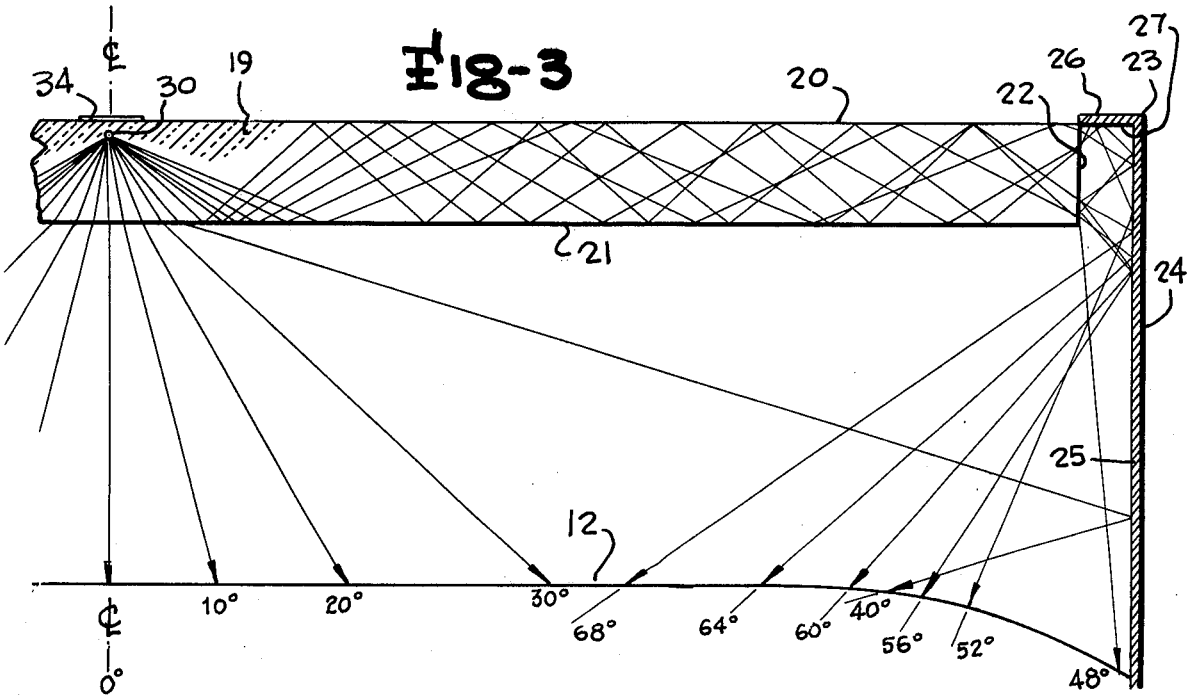

DIAL ILLUMINATION MEANS

BACKGROUND OF THE INVENTION

This invention is in the field of dial illumination means and is specifically directed to electrically operated dial illumination means usable with clocks, watches and other dial type instruments and the like such as meters, compasses, radios and a variety of other similar devices.

A number of expedients have been employed in the past for the purpose of providing illumination of watch dials. For example, phosphorescent materials have been employed for many years on watch dials with varying degrees of success and all suffering from the well-known shortcoming of being difficult to see particularly with the passage of time as the phosphorescence decreases. Moreover, the phosphorescent material requires recharging by being exposed to light in order for the phosphorescence to be maintained. In addition, the luminous materials used in dials of the foregoing type also lose their light emitting capacity with age and have generally provided substantially less than fully satisfactory performance. The shortcomings of the luminous markings have resulted in other approaches such as in the use of gas or incandescent bulbs in the manner of U.S. Pat. No. 3,018,614. Devices of the last-mentioned type employing incandescent filament operated bulbs have not been accepted for portable devices due to the fact that they require substantial battery capacity for their operation due to their substantial power requirements. Other prior art approaches to the provision of dial illuminating means are found in U.S. Pat. Nos. 3,214,577; 3,224,184; 3,278,740; 3,430,433; 3,490,266; 3,514,940; 3,574,993; 3,859,782; 3,748,456; 3,788,061; 3,855,784 and 3,899,871.

Probably the greatest shortcoming of the prior art devices is their reliance upon incandescent type bulbs employing filaments which have consequent high power requirements requiring substantial battery capacity for operation.

Another shortcoming of many of the prior art devices such as exemplified in U.S. Pat. No. 3,788,061 is due to the fact that they inefficiently rely upon a relatively powerful source which attempts to illuminate the entire area of the dial by simple radiation from the source so that those portions of the dial nearest the light source are usually overly illuminated in order that the portions spaced from the light source may have adequate illumination. Additionally, this approach tends to cause shadows especially with curved surfaces and three-dimensional objects. Other drawbacks of the prior known devices for providing dial illumination include the fact that they are bulky and are frequently both delicate and expensive.

BRIEF SUMMARY OF THE INVENTION

Therefore, the primary object of the invention is the provision of a new and improved dial illumination means.

Achievement of the object of this invention is enabled by the preferred embodiments by the employment of a unique light source consisting of a light emitting diode, henceforth referred to as LED, which is embedded in the center of the crystal of a watch and connected by two very fine conductors to a battery source which is selectively operable to actuate the LED. The crystal is of such a configuration as to direct the light rays from the LED to the area of the dial.

More specifically, the subject invention overcomes the shortcomings of the prior art devices in other embodiments in which the watch crystal in which the LED is embedded is surrounded by a cylindrical reflecting surface spaced from the cylindrical side edge of the crystal and coaxially positioned with respect thereto. A substantial portion of the light emitted from the LED is radiated in a direction so that it strikes the inner and outer face of the crystal at an angle greater than the critical angle of refraction so that the light rays do not initially escape from the lens but are reflected back and forth between the inner and outer surfaces of the lens to the edge portion of the lens from which they are refracted to strike the surrounding cylindrical reflective surface as well as an annular reflective surface parallel to the outer face of the crystal and are deflected downwardly onto a dial beneath the crystal in such a manner as to distribute the light in an apparently uniform manner such that the more central light rays from the source and the more outer rays from that same source complement and enhance one another in illuminating the area of the dial.

In another embodiment, the lens is provided with a thickened central cylindrical portion in which the LED is mounted coaxial with its axis and a thinner outer peripheral portion so that light emanating from the LED engages the cylindrical sidewall of the thicker cylindrical portion at a sufficiently low angle of incidence as to pass through the surface and be refracted downwardly to directly engage the face of the dial or to engage the peripheral reflector to be reflected back to the same portion of the dial to provide light concentration in that area of the dial desired to be illuminated.

A better understanding of the manner in which the preferred embodiments achieve the object of the invention will be enabled when the following written description is considered in conjunction with the appended drawings in which:

BRIEF DESCRIPTION OF THE DRAWING

FIG. 1 is a perspective view of a watch illustrating a first embodiment of the subject invention with portions removed for clarity of illustration;

FIG. 2 is a bisecting sectional view of the watch of FIG. 1;

FIG. 3 is an enlarged portion of a watch crystal and mounting structure illustrating the principles of the embodiment of FIGS. 1 and 2;

DETAILED DESCRIPTION OF THE INVENTION

Figure 4:
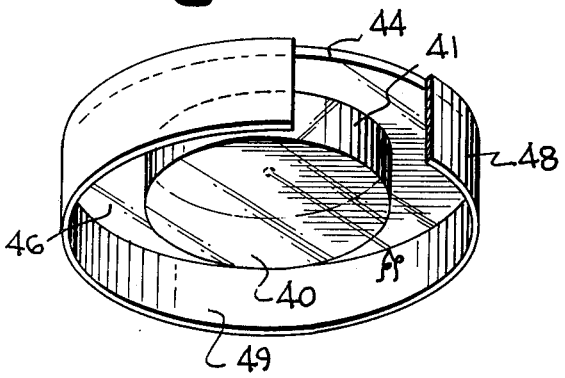
FIG. 4 is a bottom perspective view of a watch crystal in accordance with another embodiment of the invention.

Attention is initially invited to FIG. 1 of the drawings which illustrates a watch, generally designated 10, having a case 11, a face 12, hour indicators 13, hands 14 and 16 and an inner case 18 containing the mechanical or electrical workings for driving the hands, none of which comprises a part of the present invention.

A transparent cover or crystal member 19 having an outer face 20, an inner face 21, and a cylindrical edge face 22 is positioned in overlying relationship to the face 12 and is supported by a concentric support ring 23 consisting of a cylindrical portion 24 having an inwardly facing peripheral reflective surface 25 and an annular portion 26 having a downwardly facing peripheral reflective surface 27. Crystal member 19 is secured to the annular portion 26 in any desired manner such as by adhesives, mechanical connectors or the like. It should be understood that surfaces 22, 25 and 27 need not be limited to flat surfaces or cylindrical surfaces since other surfaces could also be employed; moreover, surfaces 25 and 27 will not always be round but can be square, oval, rectangular and even irregular to accommodate the many different watch case shapes. Additionally, surfaces 25 and 27 can be formed as one continuous curved surface rather than flat and cylindrical and normal to each other as shown.

An LED 30 is positioned internally of the transparent crystal 19 and is connected by thin wires 32 embedded in the crystal to a battery in the case 11 through a circuit including a current-limiting resistor and a push button switch 34 which, when depressed, completes the circuit to activate LED 30. LED 30 can be any one of several conventional constructions such as a chip of gallium phosphide or gallium arsenide and used with a integral light reflector. Probably the greatest advantage of the employment of an LED 30 as opposed to the previously employed incandescent and gas light sources is the fact that the LED need only draw a few milliamps of current so that there is only a very small power drain. Moreover, the LED has a narrow radiation band and its light emitting area is usually quite small which fact permits an extremely effective control of the light which can be directed to the desired areas of the dial in a manner to be discussed. Moreover, it is also possible that the light source can be selected to provide light of different wave lengths to give different color effects. The wires 32 and LED 30 can be molded inside the crystal 19 during the fabrication of the crystal which can be of plastic or similar material since the LED 30 emits extremely small quantities of heat.

A light shield 34 is affixed to the outer surface of the crystal 20 outwardly of LED 30 for preventing direct light radiation from the LED to pass outwardly into the eyes of the viewer. Alternatively, the light shield 34 can be embedded within the crystal 19 outwardly of the LED for effecting the shielding of the LED in the same manner and also for purposes of helping to direct the light radiation from the source to the dial in some cases. It is also possible that the spacing between the surfaces 22 and 25 could be eliminated and the shape of surface 27 and the inner face of surfaces 22 and 25 shaped so that light rays could be directed downward to the watch face.

The manner of operation of the embodiment of FIGS. 1 and 2 will be better understood with the following references to FIG. 3 which constitutes an enlarged portion of a watch similar to that of FIG. 2 with the exception of the fact that the crystal 19' of FIG. 3 is of flat configuration as compared to the slightly curved configuration of crystal 19 of FIG. 2. In any event, the crystal of FIG. 3 operates in essentially the same manner as that of FIG. 2 as will be apparent from the following discussion.

The crystal in the illustrated example is formed of refractive material having an index of refraction of 1.49 and a critical angle of approximately 42°. Light from LED 30 striking the bottom or inside face 21 of the crystal at an angle substantially less than 42° with respect to the normal to the surface passes through surface 21 and is retracted downwardly onto the central portion of the dial 12 in a dispersed manner as will be apparent from the rays designated 10°, 20° and 30° as illustrated in FIG. 3. Rays more closely approaching the critical angle such as the 40° ray are also refracted through surface 21 but are oriented so as to travel to the inwardly facing reflector surface 25 of cylindrical portion 24 from which they are reflected downwardly onto the outer peripheral portion of dial 12 in which the visible indicators 13 are provided. Rays such as those labeled 52°, 56°, 60°, 64° and 68° are reflected from inner or lower face 21 of the crystal so as to be reflected back and forth between that face and the outer or upper face 20 so that they eventually engage the cylindrical edge face 22 at an angle less than the critical angle and consequently pass through the cylindrical edge face to strike the reflective surface 25 and then proceed on to surface 12 on which the visible indicators 13 are located.

FIG. 4 illustrates another embodiment of the invention which constitutes a variation of the embodiment of FIG. 3 for providing a distribution of light in the portion of the face 12 near its outer periphery. The crystal member comprises a central relatively thick cylindrical portion 40 having a cylindrical edge surface 41 and an inner face 42 with an outer annular portion 44 extending unitarily from the central cylindrical portion 40. Annular portion 44 is transparent having a partially reflective surface 46 with the outer edge of annular portion 44 being engaged with and extending to a cylindrical ring 48 having an inner reflective surface 49. The relative dimensions of the components and the spacing of surface 41 from surface 49 are such that the outer light rays emanating from LED 30 concentrically mounted in the lens are concentrated primarily in the area of the face 12 beneath the annular member 44 as shown in FIG. 5.

Figure 6:
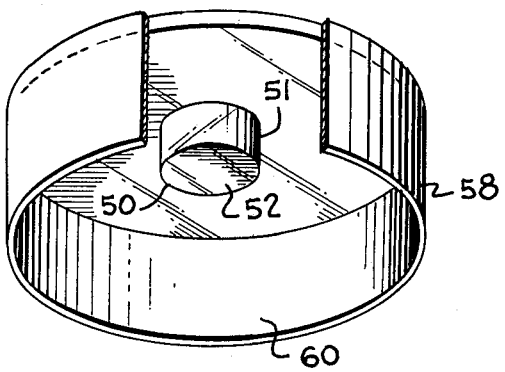
FIG. 6 is a bottom perspective view of another embodiment of the invention.
Figure 5:
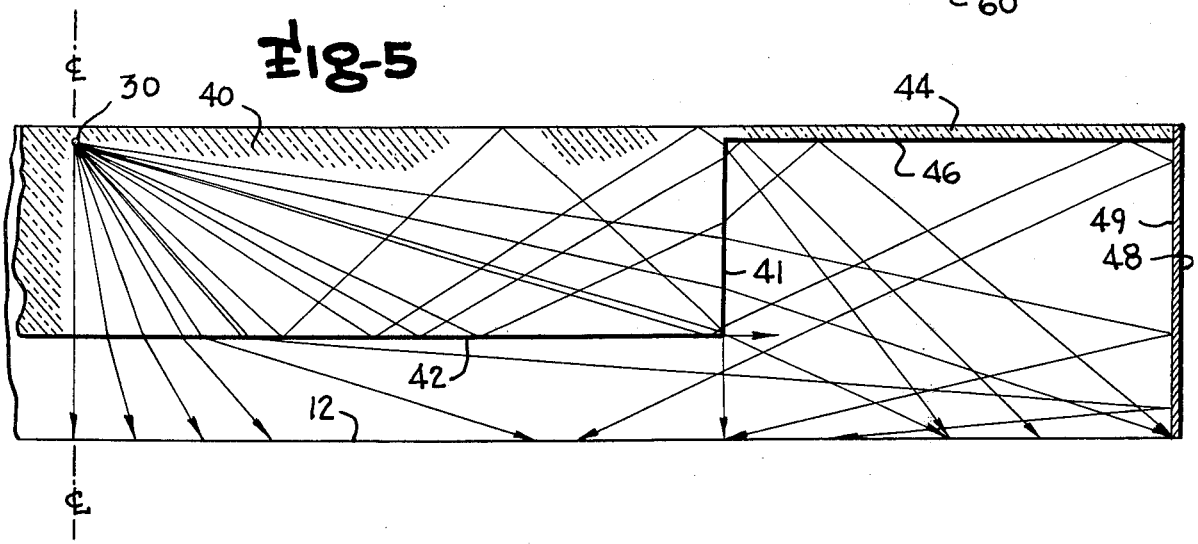
FIG. 5 is an enlarged view of a portion of the crystal of FIG. 4.
Figure 7:
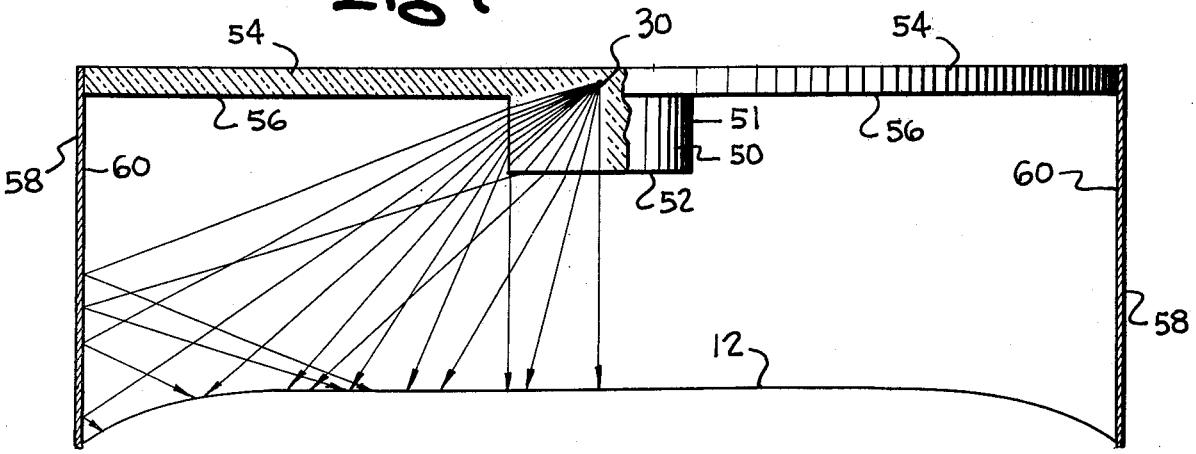
FIG. 7 is a partial bisecting sectional view of the embodiment of FIG. 6.

FIGS. 6 and 7 illustrate a further embodiment of the invention similar to that of FIGS. 4 and 5 but in which the central cylindrical portion 50 is of relatively small diameter as compared to the outer diameter of an annular portion 54. Light rays emanating from LED 30 in FIG. 7 are directed through the cylindrical outer edge surface 51 and the bottom face 52 of cylindrical member 50 so as to illuminate the area of the dial 12. It will be noted that the cylindrical ring 58 includes a surface 60 of reflective nature and that the lower face 56 of the annular portion 54 is like surface 46 of annular portion 44 which, while not a mirror since the user must be able to look through portion 44 to see the dial, reflects rays emanating from surface 51 due to their angle of incidence which is sufficiently great as to cause reflection of the rays.

It should be appreciated that the embodiments of FIGS. 4 and 6 are merely illustrative of the fact that the relative dimensions of the components can be varied considerably for effecting light illumination in the area of face 12 in accordance with the positioning of the time indicators on the face 12.

Numerous modifications of the disclosed embodiments will undoubtedly occur to those of skill in the art and it should therefore be understood that the spirit and scope of the invention is to be limited solely by the appended claims.

I claim:

1. In a watch having a face with visual hour indicators, the improvement comprising a transparent crystal member having an inner face and an outer face positioned over the watch face and having a peripheral edge, light source means positioned internally of said crystal member, a source of electrical voltage selectively connectable to said light source means for actuation of said light source means, reflector means positioned radially outwardly of the peripheral edge of said crystal member for receiving light rays directly from the peripheral edge of said crystal member which have been cirected internally of said crystal from said light source means and for reflecting and concentrating substantially all of said light rays emitted from the peripheral edge of the crystal member in the area of said dial in which said visual indicators are located.

2. The invention of claim 1 additionally including light-impervious glare shield means supported by said crystal member outwardly of said light source means for shielding said light source means from the vision of a user of the watch as viewed when the user is looking at the watch face such as when ascertaining the time designated thereby.

3. The invention of claim 1 additionally including light-impervious glare shield means supported by said crystal outwardly of said light source means for shielding said light source means from the vision of a user of the watch as viewed when the user is looking at the watch face to ascertain the time designated thereby and said reflector means includes a cylindrical reflector surface positioned from the edge surface of said crystal and extending from a position adjacent the face of said watch to a position in alignment with the outer face of said crystal.

4. The invention of claim 3 additionally including an annular shaped reflective surface extending between the cylindrical reflector surface and the outer edge surface of said crystal oriented in a plane substantially parallel to the plane of said watch face.

5. The invention of claim 1 wherein said light source means is a light emitting diode.

6. The invention of claim 5 additionally including light-impervious glare shield means supported by said crystal member outwardly of said light source means for shielding said light source means from the vision of a user of the watch as viewed when the user is looking at the watch face such as when ascertaining the time designated thereby.

7. The invention of claim 5 additionally including light-impervious glare shield means supported by said crystal outwardly of said light source means for shielding said light source means from the vision of a user of the watch as viewed when the user is looking at the watch face to ascertain the time designated thereby and said reflector means includes a cylindrical reflector surface positioned from the cylindrical edge surface of said crystal and extending between the face of said watch and a position in alignment with the outer face of said crystal.

8. The invention of claim 7 additionally including an annular shaped reflective surface extending between the cylindrical reflective surface and the cylindrical outer edge surface of said crystal oriented in a plane substantially parallel to the plane of said watch face.

9. The invention of claim 1 wherein said light source means comprises a light emitting diode, said crystal member comprises a relatively thick central cylindrical portion in which said LED is coaxially positioned and an outer annular portion of substantially less thickness having an outer face and an inner face, said inner face of said annular portion comprising a partially reflective surface.

10. The invention of claim 9 additionally including a light-impervious shield positioned outwardly of said light emitting diode for shielding said LED from the eyes of a viewer of said watch.

11. The invention of claim 10 wherein said reflector means comprises a cylindrical reflector surface positioned coaxially with respect to said central cylindrical portion outwardly of said annular portion and extending from said watch face to a position adjacent said annular portion.

12. In a dial-type meter or the like having a dial with visual indicators, the improvement comprising a transparent cover member positioned over the dial and having a peripheral edge portion, a light emitting diode positioned internally of said transparent cover member, a source of electrical voltage selectively connectable to said light emitting diode for actuation of said light emitting diode, reflector means positioned radially outwardly of the peripheral edge portion of said transparent cover member for receiving light rays from said transparent cover member directed internally of said cover member from said light emitting diode for reflecting and concentrating substantially all of said light rays emitted from the peripheral edge of said cover member in the area of said dial in which said visual indicators are located.

13. The invention of claim 12 additionally including a light-impervious shield positioned on said transparent cover member outwardly of said LED for shielding said light emitting diode from the vision of a user of the meter or the like looking at the dial.

14. The invention of claim 12 wherein said transparent cover member is a unitary plastic member including a relatively thick central cylindrical portion having a cylindrical edge surface with an axis perpendicular to said dial, said light emitting diode being coaxially positioned in said central cylindrical portion, said transparent cover member further including an annular portion of substantially less thickness than said central cylindrical portion having an outer face and an inner face, said inner face of said annular portion comprising a partially reflective surface.

15. The invention of claim 14 wherein said reflector means comprises a cylindrical reflector surface positioned coaxially with respect to said central cylindrical portion outwardly of said annular portion and extending from said dial to a position adjacent said annular portion.

16. The invention of claim 15 wherein light rays from said light emitting diode passing through said cylindrical edge surface strike said cylindrical reflector surface and are deflected to and concentrated at a desired area of said dial.

* * * * *